US011273346B2

(12) United States Patent
Shimahara

(10) Patent No.: US 11,273,346 B2
(45) Date of Patent: Mar. 15, 2022

(54) GOLF CLUB HEAD

(71) Applicant: SUMITOMO RUBBER INDUSTRIES, LTD., Kobe (JP)

(72) Inventor: Yuki Shimahara, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 0 days.

(21) Appl. No.: 16/271,453

(22) Filed: Feb. 8, 2019

(65) Prior Publication Data

US 2019/0247724 A1 Aug. 15, 2019

(30) Foreign Application Priority Data

Feb. 9, 2018 (JP) ..... JP2018-021537

(51) Int. Cl.

*A63B 53/00* (2015.01)
*A63B 53/04* (2015.01)
*A63B 102/32* (2015.01)

(52) U.S. Cl.

CPC ..... *A63B 53/04* (2013.01); *A63B 53/0412* (2020.08); *A63B 53/0437* (2020.08); *A63B 53/0466* (2013.01); *A63B 2102/32* (2015.10)

(58) Field of Classification Search

CPC .... A63B 2053/0437; A63B 2053/0479; A63B 53/0475

See application file for complete search history.

(56) References Cited

U.S. PATENT DOCUMENTS 4,065,133 A * 12/1977 Gordos ..... A63B 53/047 473/327
4,139,196 A * 2/1979 Riley ..... A63B 60/00 473/242
4,754,974 A * 7/1988 Kobayashi ..... A63B 53/04 473/327
6,783,465 B2 * 8/2004 Matsunaga ..... A63B 60/52 473/329
7,250,007 B2 * 7/2007 Lu ..... A63B 60/52 473/329

(Continued)

FOREIGN PATENT DOCUMENTS

JP 08-280853 A 10/1996
JP 2004-041376 A 2/2004

(Continued)

OTHER PUBLICATIONS

Kakiuchi, Machine Translation of JP Pub. No. 2010-279847 A, uploaded May 17, 2021, Espacenet, 6 pages.*

*Primary Examiner* — Eugene L Kim
*Assistant Examiner* — Matthew B Stanczak
(74) *Attorney, Agent, or Firm* — Birch, Stewart, Kolasch & Birch, LLP

(57) ABSTRACT

A head includes a face, a sole and a crown. The crown includes a first region and a second region. The first region includes a peak portion of the crown. The first region includes a first thick portion and a narrow groove. The second region includes a second thick portion. The narrow groove extends from a toe side to a heel side so as to divide the first region. The second region extends from the toe side of the first region, through a back side of the first region, to the heel side of the first region. The second thick portion has a wall thickness smaller than that of the first thick portion.

26 Claims, 10 Drawing Sheets

(56) References Cited

U.S. PATENT DOCUMENTS 9,144,721 B2 * 9/2015 Golden ..... A63B 60/02
9,403,070 B2 * 8/2016 Stokke ..... A63B 53/0466
9,839,819 B2 * 12/2017 Mizutani ..... A63B 60/52
9,975,011 B1 * 5/2018 Wester ..... A63B 53/0466
10,286,265 B2 * 5/2019 Tsunashima ..... A63B 53/0466
10,449,424 B2 * 10/2019 Cole ..... A63B 53/0466
2003/0114244 A1 * 6/2003 Matsunaga ..... A63B 60/52 473/345
2004/0014534 A1 * 1/2004 Hocknell ..... A63B 60/00 473/349
2004/0048685 A1 * 3/2004 Tsunoda ..... A63B 60/42 473/345
2005/0124436 A1 * 6/2005 Kakiuchi ..... A63B 60/00 473/345
2006/0100031 A1 * 5/2006 Lan ..... A63B 53/0466 473/345
2006/0287131 A1 * 12/2006 Hirano ..... A63B 60/00 473/345
2007/0082751 A1 * 4/2007 Lo ..... A63B 53/04 473/329
2008/0081709 A1 * 4/2008 Hirano ..... A63B 53/0466 473/346
2010/0048325 A1 * 2/2010 Tanimoto ..... A63B 60/02 473/346
2011/0183776 A1 * 7/2011 Breier ..... A63B 53/0466 473/346
2012/0100930 A1 * 4/2012 Hayase ..... A63B 53/0466 473/345
2012/0129627 A1 * 5/2012 Hirano ..... A63B 53/0466 473/346
2012/0135821 A1 * 5/2012 Boyd ..... A63B 60/00 473/342
2012/0142452 A1 * 6/2012 Burnett ..... A63B 53/0475 473/345
2013/0344987 A1 * 12/2013 Takechi ..... A63B 60/52 473/345
2014/0080626 A1 * 3/2014 Bezilla ..... A63B 60/52 473/332
2014/0106903 A1 * 4/2014 Nakamura ..... A63B 60/54 473/346
2014/0213389 A1 * 7/2014 Yamamoto ..... A63B 53/0454 473/345
2014/0274448 A1 * 9/2014 Willett ..... A63B 53/0466 473/327
2015/0045147 A1 * 2/2015 Abe ..... A63B 60/00 473/345
2015/0072803 A1 * 3/2015 Golden ..... A63B 53/04 473/345
2015/0094161 A1 * 4/2015 Stokke ..... A63B 53/0466 473/324
2015/0094164 A1 * 4/2015 Galvan ..... A63B 53/06 473/329
2015/0119166 A1 * 4/2015 Deshmukh ..... A63B 60/00 473/349
2015/0238827 A1 * 8/2015 Nakamura ..... A63B 53/04 473/345
2016/0129319 A1 * 5/2016 Bennett ..... A63B 60/54 473/345
2016/0158609 A1 * 6/2016 Takagi ..... A63B 53/0466 473/345
2016/0184664 A1 * 6/2016 Mizutani ..... A63B 60/52 473/345
2016/0184666 A1 * 6/2016 Mizutani ..... A63B 53/0466 473/342
2017/0014690 A1 * 1/2017 Morin ..... A63B 60/00
2017/0050093 A1 * 2/2017 Mizutani ..... A63B 53/0466
2017/0319919 A1 * 11/2017 Cole ..... A63B 53/0466
2017/0333767 A1 * 11/2017 Cole ..... A63B 53/0466
2018/0161644 A1 * 6/2018 Yoshida ..... A63B 53/04
2018/0250559 A1 * 9/2018 Tsunashima ..... A63B 60/52
2019/0275388 A1 * 9/2019 Golden ..... A63B 60/00

FOREIGN PATENT DOCUMENTS

JP 2005-073736 A 3/2005
JP 2010-279847 A * 12/2010 ..... A63B 53/04
JP 2014-100186 A 6/2014
JP 2016-106886 A 6/2016
JP 6394826 * 9/2018

* cited by examiner

GOLF CLUB HEAD

The present application claims priority on Patent Application No. 2018-021537 filed in JAPAN on Feb. 9, 2018. The entire contents of this Japanese Patent Application are hereby incorporated by reference.

BACKGROUND OF THE INVENTION

Field of the Invention

The present disclosure relates to a golf club head.

Description of the Related Art

In a hollow head, a golf club head in which a wall thickness of a crown changes has been disclosed (for example, see JP8-280853).

SUMMARY OF THE INVENTION

The inventor of the present application has found a crown that can achieve an advantageous effect heterogeneous from the effect of the conventional technique. An object of the present disclosure is to provide a golf club head capable of consistently achieving a great flight distance by a new structure of a crown thereof.

In one aspect, a golf club head may include a face, a sole and a crown. The crown may include a first region and a second region. The first region may include a peak portion of the crown. The first region may include a first thick portion and a narrow groove. The second region may include a second thick portion. The narrow groove may extend from a toe side to a heel side so as to divide the first region. The second region may extend from the toe side of the first region, through a back side of the first region, to the heel side of the first region. The second thick portion may have a wall thickness smaller than that of the first thick portion.

In another aspect, the crown may include a peak vicinity region that is located on an up-down direction position falling within 12 mm of the peak portion. The first thick portion may be included in the peak vicinity region.

In another aspect, the narrow groove may be formed on an inner surface of the crown.

In another aspect, the narrow groove may be formed on an outer surface of the crown.

A wall thickness of the crown in the first thick portion is denoted by T1 (mm), a wall thickness of the crown in the second thick portion is denoted by T2 (mm), and a wall thickness of the crown in the narrow groove is denoted by TG (mm). T1 may be greater than T2. T2 may be greater than TG.

In another aspect, the number of the narrow grooves may be greater than or equal to 1 and less than or equal to 8.

In another aspect, the narrow groove may extend along an upper end edge of the face.

In another aspect, the crown may further include a transition region located between the first region and the second region. The narrow groove may extend so as to divide the transition region.

In another aspect, the head may have a volume of greater than or equal to 400 cc.

DESCRIPTION OF THE PREFERRED EMBODIMENTS

The following will describe embodiments in detail with appropriate reference to the drawings.

Figure 10:
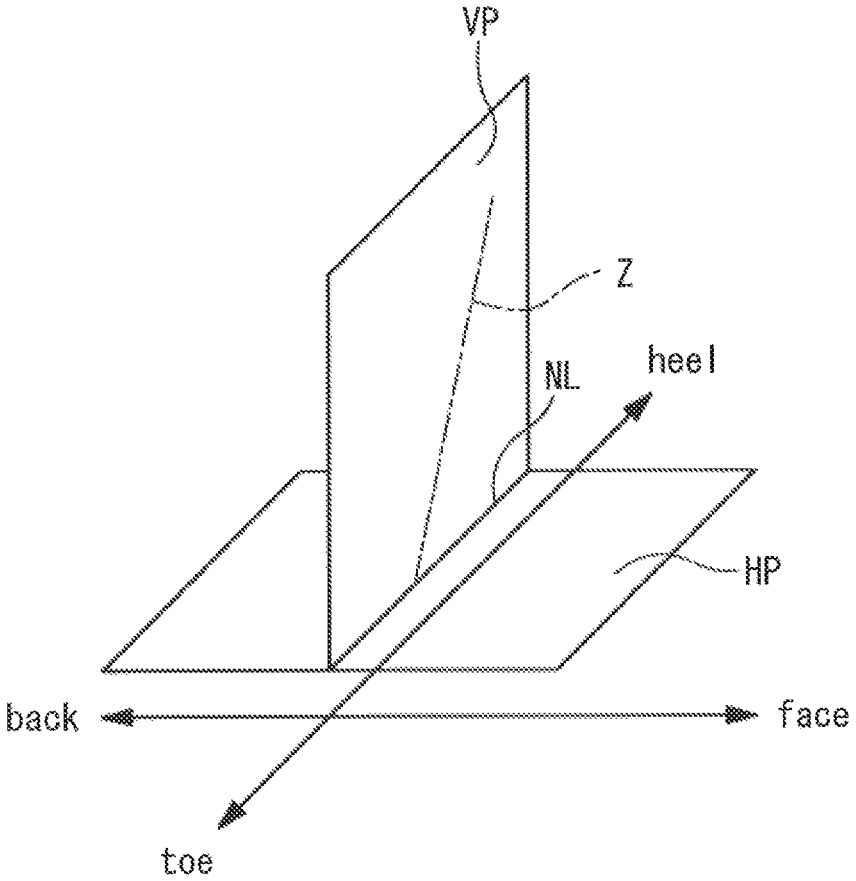
FIG. 10 is a schematic diagram for illustrating a reference state.

A reference state, a reference vertical plane, a face-back direction, a toe-heel direction, and an up-down direction are defined in the present application. A state where a head 2 is placed on a horizontal plane HP at a predetermined lie angle and real loft angle is defined as the reference state. As shown in FIG. 10, in the reference state, a plane VP perpendicular to the horizontal plane HP includes a center line Z of a hosel hole. The plane VP is defined as the reference vertical plane. The predetermined lie angle and real loft angle are described, for example, in a product catalogue.

In the present application, the toe-heel direction is the direction of an intersection line NL of the reference vertical plane VP and the horizontal plane HP (see FIG. 10).

In the present application, the face-back direction is a direction that is perpendicular to the toe-heel direction and parallel to the horizontal plane HP.

In the present application, the up-down direction is a direction that is perpendicular to the toe-heel direction and perpendicular to the face-back direction. In other words, in the present application, the up-down direction is a direction that is perpendicular to the horizontal plane HP.

In the present application, a face center Fc is defined. The face center Fc is determined as follows. First, an arbitrary point Pr roughly in the vicinity of the center of a face surface in the up-down direction and the toe-heel direction is selected. Next, a plane that passes through the point Pr, extends along the direction of a line normal to the face surface at the point Pr, and is parallel to the toe-heel direction is determined. The line of intersection of the plane and the face surface is drawn, and a midpoint Px thereof is determined. Next, a plane that passes through the midpoint Px, extends along the direction of a line normal to the face surface at the point Px, and is parallel to the up-down direction is determined. The line of intersection of the plane and the face surface is drawn, and a midpoint Py thereof is determined. Next, a plane that passes through the midpoint Py, extends along the direction of a line normal to the face surface at the point Py, and is parallel to the toe-heel direction is determined. The line of intersection of the plane and the face surface is drawn, and a midpoint Px thereof is newly determined. Next, a plane that passes through the new midpoint Px, extends along the direction of a line normal to the face surface at the point Px, and is parallel to the up-down direction is determined. The line of intersection of the plane and the face surface is drawn, and a midpoint Py thereof is newly determined. By repeating this process, Px and Py are sequentially determined. During the repeat of this process, when the distance between a new midpoint Py and the immediately previous midpoint Py becomes 0.5 mm or less for the first time, the new position Py (the final position Py) is set as the face center Fc.

Figure 1:
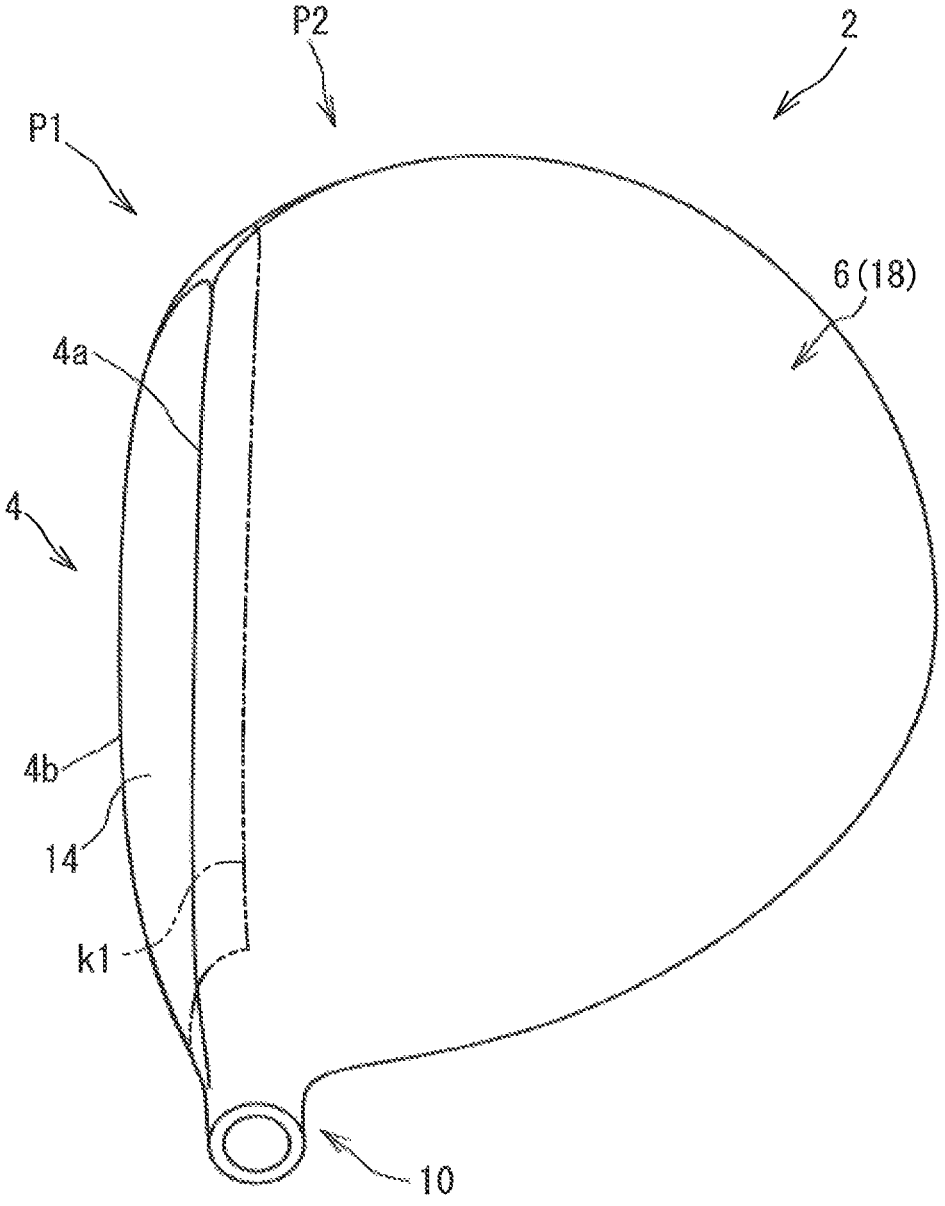
FIG. 1 is a plan view of a golf club head according to one embodiment.
Figure 2:
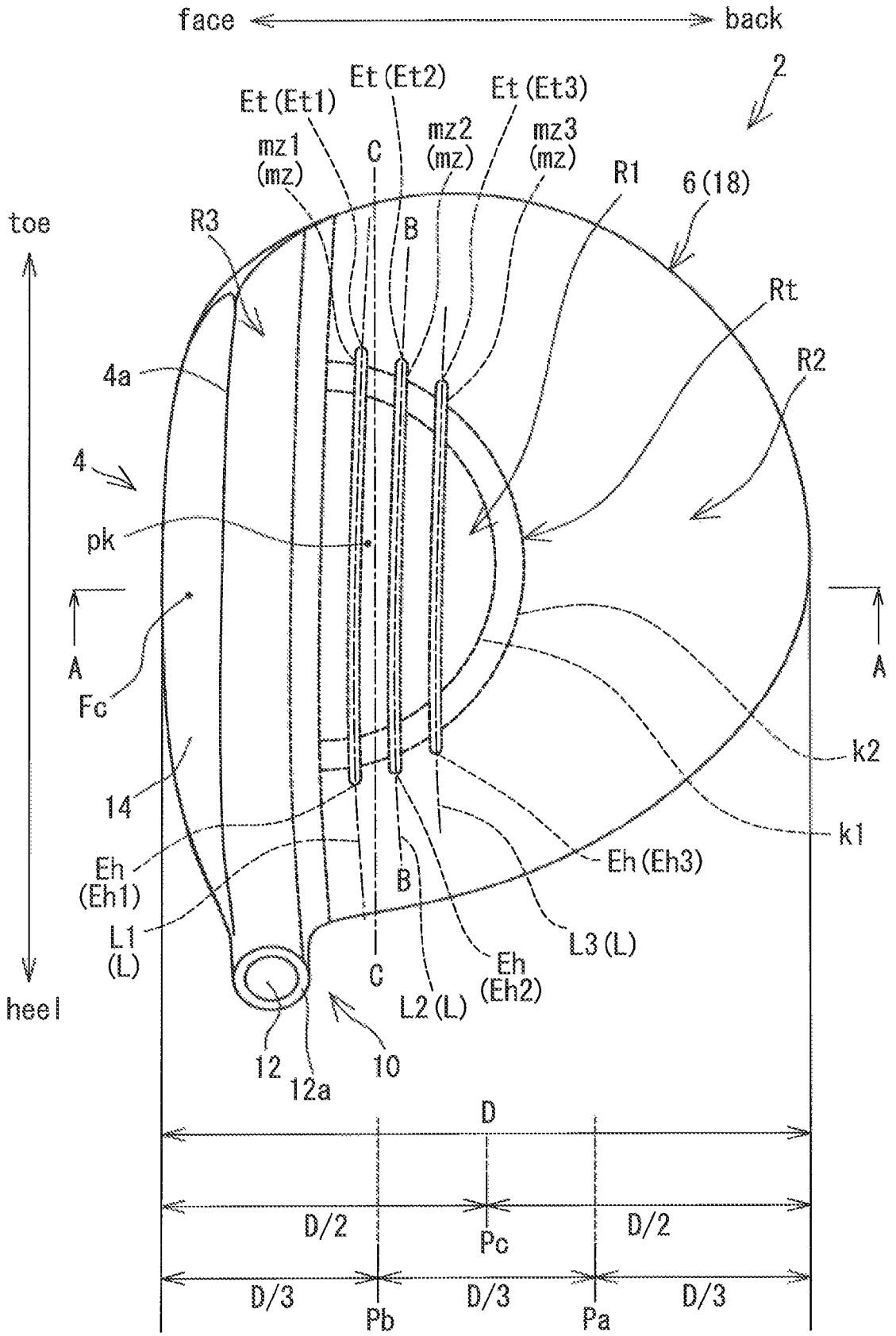
FIG. 2 is the same plan view as FIG. 1, and lines on the inner surface of a crown are shown with dashed lines in FIG. 2.
Figure 3:
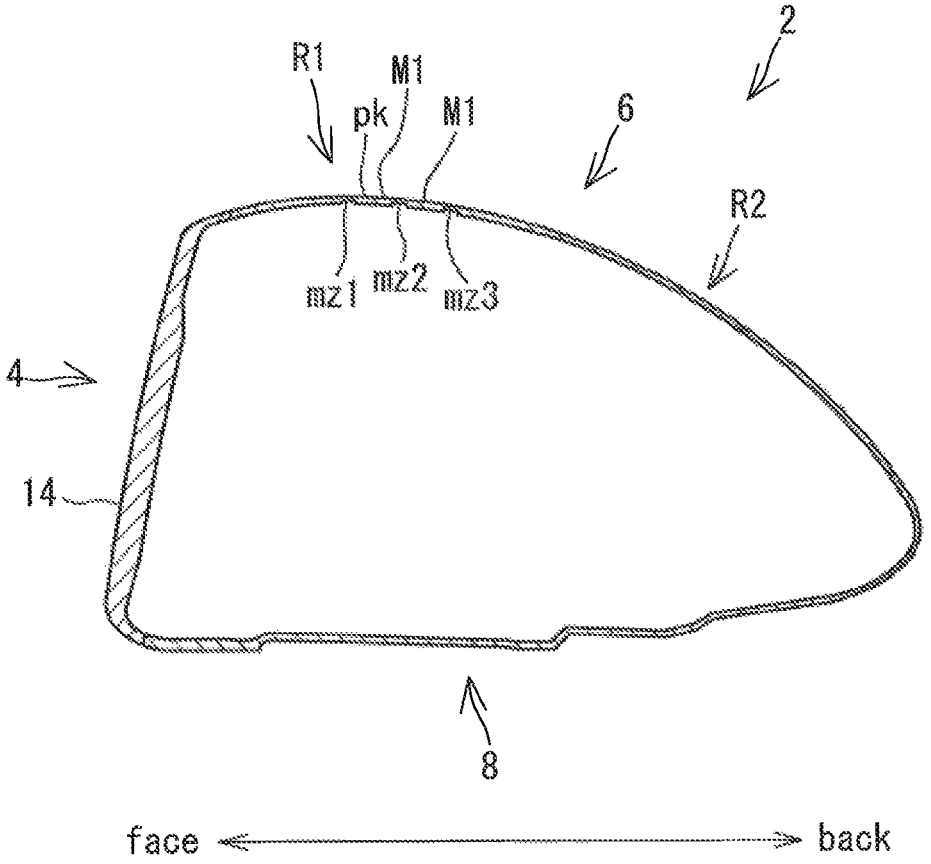
FIG. 3 is a cross-sectional view taken along line A-A in FIG. 2.
Figure 4:
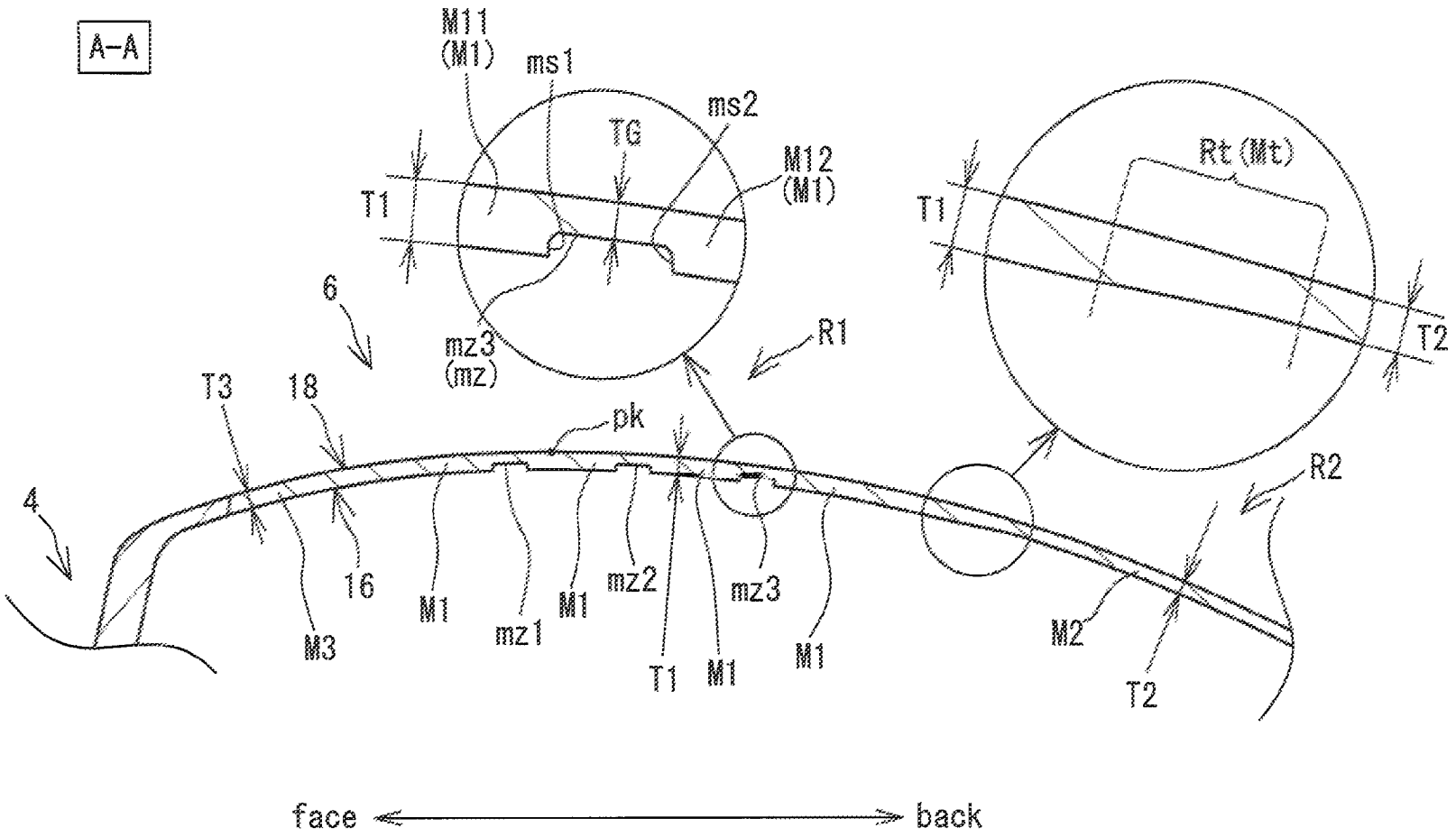
FIG. 4 is an enlarged cross-sectional view showing a part of FIG. 3.
Figure 5:
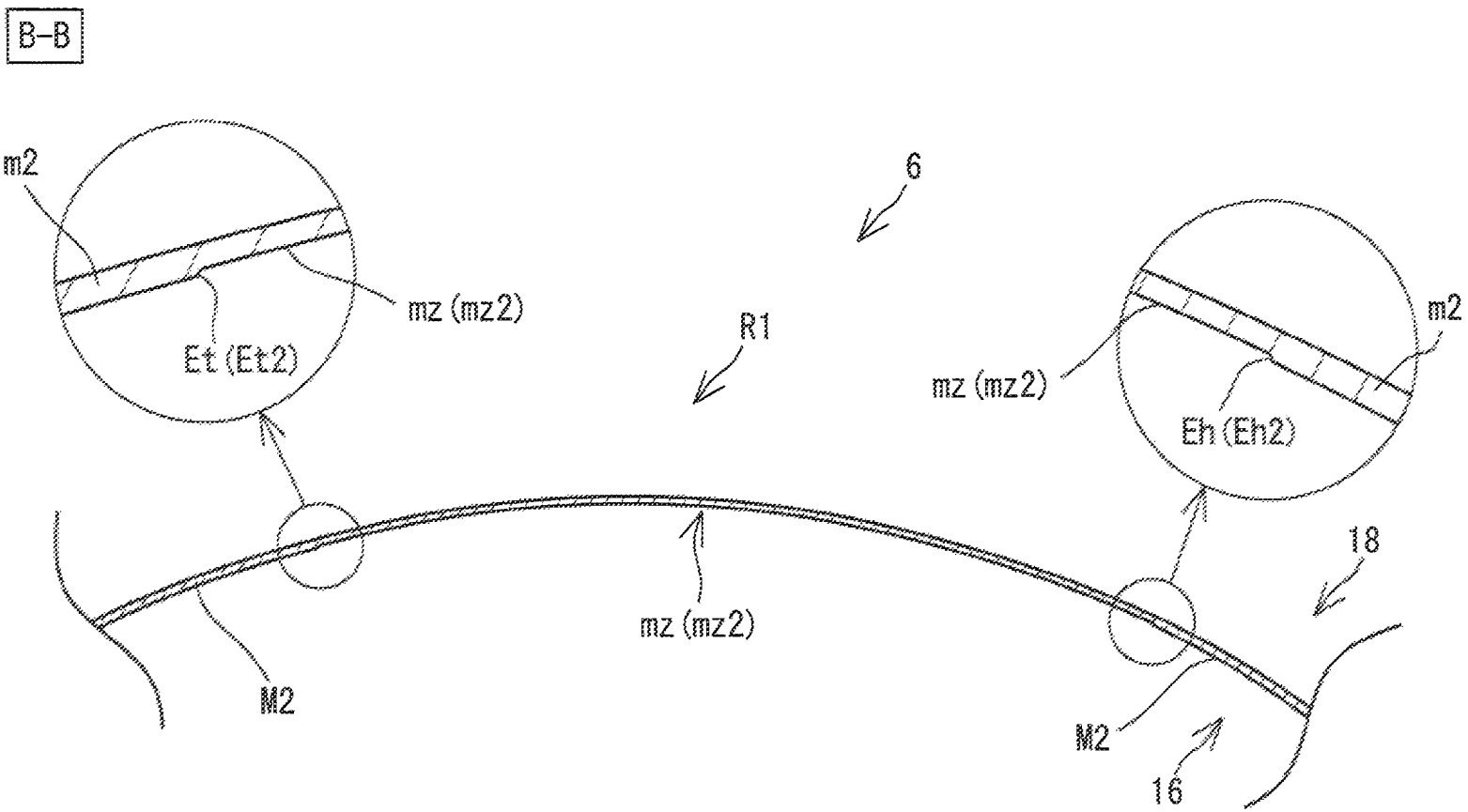
FIG. 5 is a cross-sectional view taken along line B-B in FIG. 2.
Figure 6:
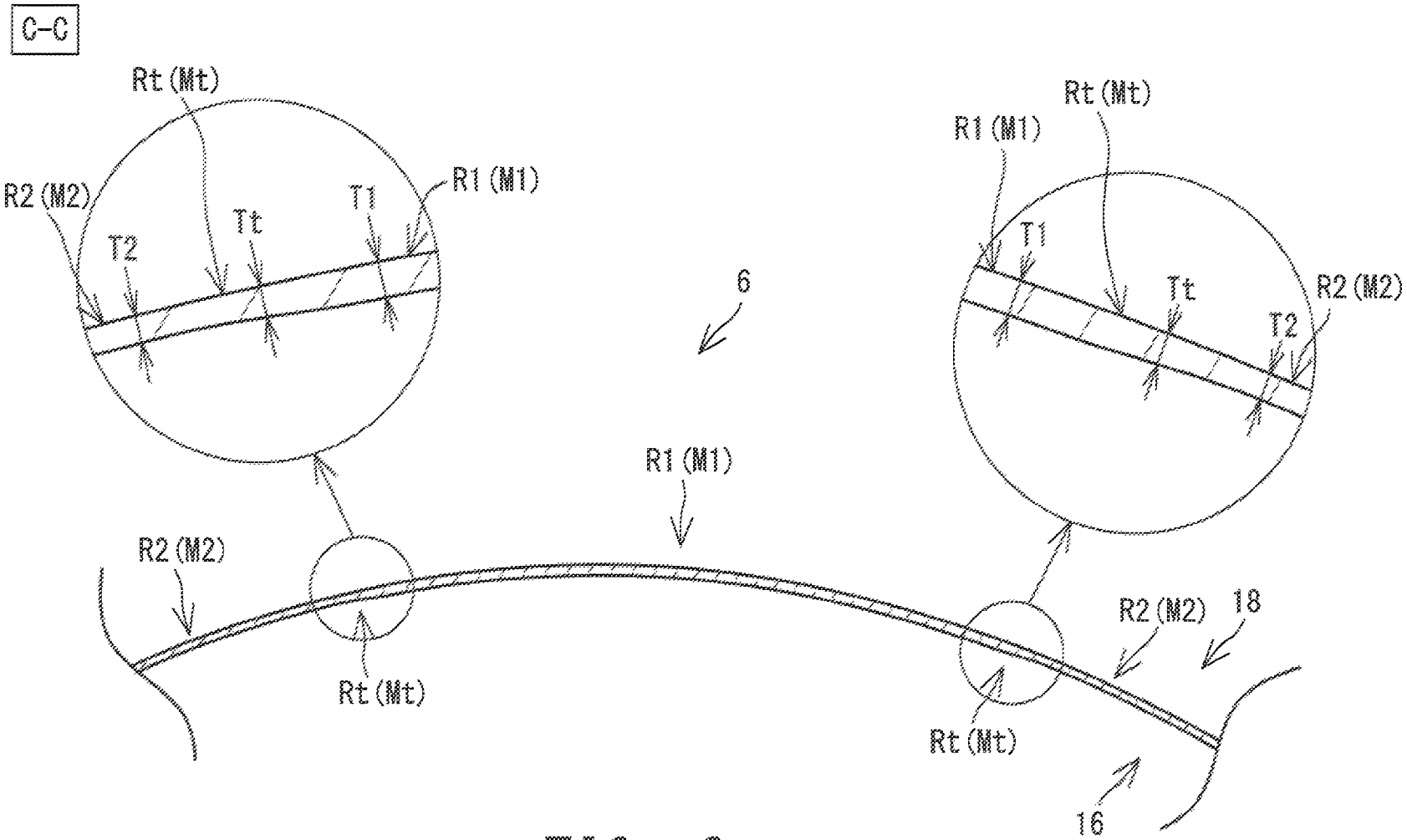
FIG. 6 is a cross-sectional view taken along line C-C in FIG. 2.
Figure 7:
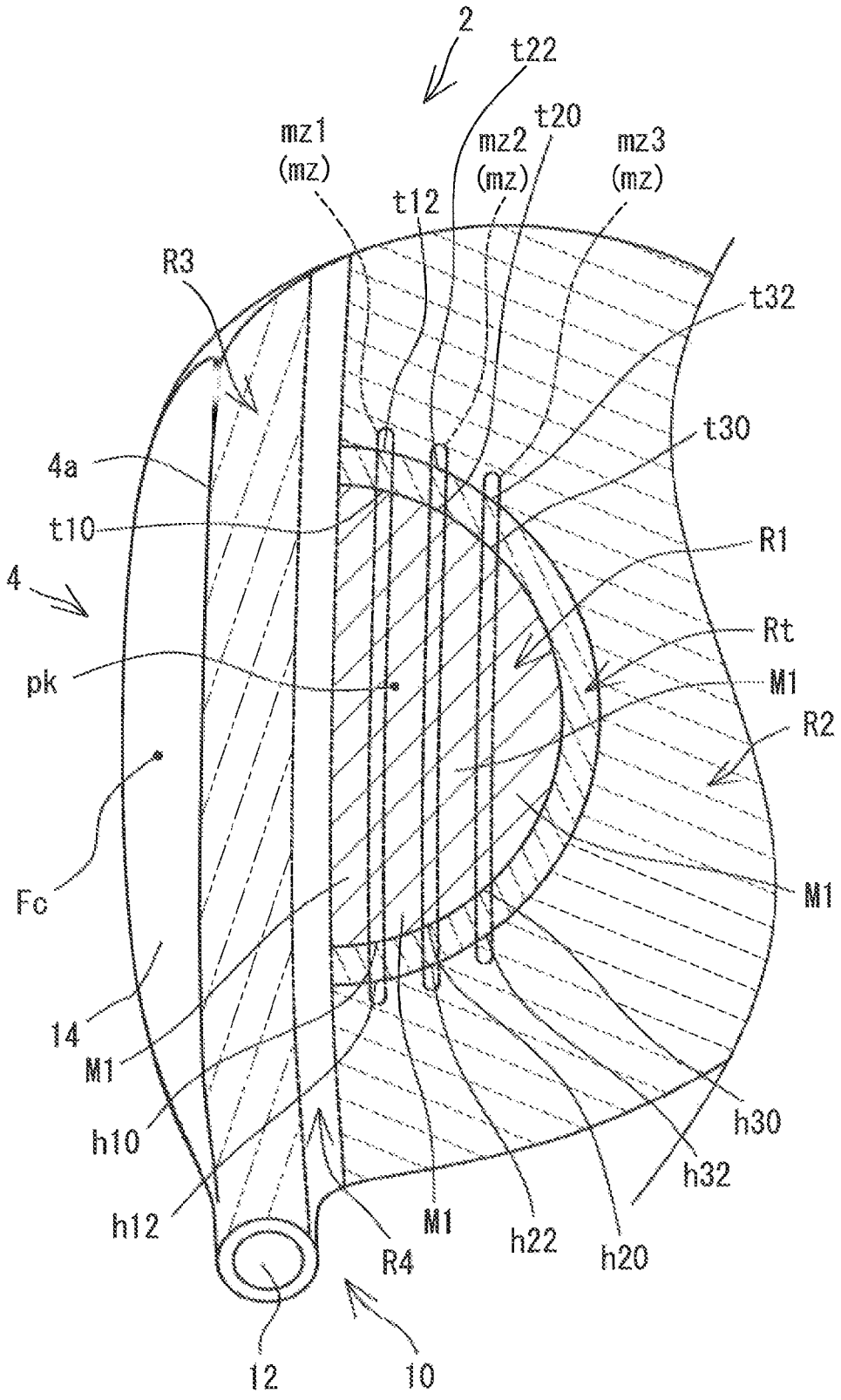
FIG. 7 is a plan view in which regions of a crown 6 are shown with respective hatchings.

FIG. 1 is a plan view of the golf club head 2 according to a first embodiment. FIG. 2 is the same plan view as FIG. 1. In FIG. 2, lines on an inner surface of a crown are shown by dashed lines. FIG. 3 is a cross-sectional view taken along line A-A in FIG. 2. FIG. 4 is an enlarged cross-sectional view in which a part of FIG. 3 is enlarged. FIG. 5 is a cross-sectional view taken along line B-B in FIG. 2. FIG. 6 is a cross-sectional view taken along line C-C in FIG. 2. FIG. 7 is an enlarged plan view in which a part of the crown in FIG. 2 is enlarged.

The head 2 includes a face 4, a crown 6, a sole 8, and a hosel 10. The face 4 includes a hitting surface 14. The crown 6 extends from an upper edge 4*a* of the face 4 toward the back of the head. The sole 8 extends from a lower edge 4*b* of the face 4 toward the back of the head. The hosel 10 includes a hosel hole 12. The head 2 is hollow. The head 2 is a wood type golf club head.

The head 2 has a two-piece structure. Members constituting the head 2 are a face member P1 and a head body P2. The face member P1 and the head body P2 are welded to each other to produce the head 2. In FIG. 1, a boundary line k1 between the face member P1 and the head body P2 is shown by a two-dot chain line.

The crown 6 includes an inner surface 16 and an outer surface 18. The inner surface 16 is a curved surface that projects toward an outside of the head. The inner surface 16 faces a hollow portion of the head 2. The inner surface 16 is not visually recognized in the finished head 2. The outer surface 18 is a curved surface that projects toward the outside of the head. The whole outer surface 18 is smoothly continuous.

The crown 6 includes a peak portion pk. Of the crown 6, a portion located on the uppermost position in the up-down direction is the peak portion pk. The peak portion pk is determined based on the position of the outer surface 18 of the crown 6. The up-down direction position of the peak portion pk is the uppermost in the outer surface 18. In the present embodiment, the outer surface 18 of the crown 6 is a curved surface that projects upward. The peak portion pk is substantially a point.

The crown 6 includes a first region R1 and a second region R2. The first region R1 is a region including the peak portion pk of the crown 6. The second region R2 extends from the toe side of the first region R1, through the back side of the first region R1, to the heel side of the first region R1. In a planar view, the second region R2 preferably occupies 50% or more of the area of the crown 6, more preferably occupies 60% or more of the area of the crown 6, and still more preferably occupies 70% or more of the area of the crown 6.

The crown 6 further includes a third region R3. The third region R3 is adjacent to the upper edge 4*a* of the face 4. The third region R3 extends from the toe side toward the heel side. The third region R3 extends along the upper edge 4*a* of the face 4. The third region R3 is located on the face side relative to the first region R1. The third region R3 is located on the face side relative to the second region R2.

The first region R1 has a semicircular shape that projects backward.

A double-pointed arrow D in FIG. 2 shows a head width. The head width D is a face-back direction width of the head 2. A position Pa and a position Pb shown in FIG. 2 are two positions by which the head width D is divided into three equal parts. The position Pa is a position separated by (⅓)D from the backmost point in the head 2. The position Pb is a position separated by (⅔)D from the backmost point in the head 2.

The first region R1 is located on the face side relative to the position Pa. The whole first region R1 is located on the face side relative to the position Pa.

The first region R1, the second region R2 and the third region R3 will be described in detail later.

The crown 6 includes a narrow groove mz. The narrow groove mz is provided on the inner surface 16 of the crown 6. The narrow groove mz may be provided on the outer surface 18 of the crown 6. The narrow groove mz may be provided on both the inner surface 16 and the outer surface 18 of the crown 6.

In the present embodiment, a plurality of narrow grooves mz are provided. In the present embodiment, the number of the narrow grooves mz is greater than or equal to 2. In the present embodiment, the number of the narrow grooves mz is 3. The crown 6 includes a narrow groove mz1 located on the most face side, and a narrow groove mz3 located on the most back side. The crown 6 further includes a narrow groove mz2 located between the narrow groove mz1 and the narrow groove mz3.

The narrow groove mz1 located on the most face side extends from the toe side to the heel side. A toe-side end of the narrow groove mz1 is located on the toe side relative to the face center Fc. The toe-side end of the narrow groove mz1 is located on the toe side relative to the peak portion pk. A heel-side end of the narrow groove mz1 is located on the heel side relative to the face center Fc. The heel-side end of the narrow groove mz1 is located on the heel side relative to the peak portion pk.

The narrow groove mz3 located on the most back side extends from the toe side to the heel side. A toe-side end of the narrow groove mz3 is located on the toe side relative to the face center Fc. The toe-side end of the narrow groove mz3 is located on the toe side relative to the peak portion pk. A heel-side end of the narrow groove mz3 is located on the heel side relative to the face center Fc. The heel-side end of the narrow groove mz3 is located on the heel side relative to the peak portion pk.

The narrow groove mz2 located between the narrow groove mz1 and the narrow groove mz3 extends from the toe side to the heel side. A toe-side end of the narrow groove mz2 is located on the toe side relative to the face center Fc. The toe-side end of the narrow groove mz2 is located of the toe side relative to the peak portion pk. A heel-side end of the narrow groove mz2 is located of the heel side relative to the face center Fc. The heel-side end of the narrow groove mz2 is located on the heel side relative to the peak portion pk.

All the narrow grooves mz extend from the toe side to the heel side. The toe-side ends of all the narrow grooves mz are located on the toe side relative to the face center Fc. The toe-side ends of all the narrow grooves mz are located on the toe side relative to the peak portion pk. The heel-side ends of all the narrow grooves mz are located on the heel side relative to the face center Fc. The heel-side ends of all the narrow grooves mz are located on the heel side relative to the peak portion pk.

The narrow groove mz1 extends substantially along the toe-heel direction. The absolute value of an angle between the narrow groove mz1 and the toe-heel direction is preferably less than or equal to 20 degrees, more preferably less than or equal to 15 degrees, and still more preferably less than or equal to 10 degrees.

The narrow groove mz2 extends substantially along the toe-heel direction. The absolute value of an angle between the narrow groove mz2 and the toe-heel direction is preferably less than or equal to 20 degrees, more preferably less than or equal to 15 degrees, and still more preferably less than or equal to 10 degrees.

The narrow groove mz3 extends substantially along the toe-heel direction. The absolute value of an angle between the narrow groove mz3 and the toe-heel direction is preferably less than or equal to 20 degrees, more preferably less than or equal to 15 degrees, and still more preferably less than or equal to 10 degrees.

The angle between each narrow groove mz and the toe-heel direction means an angle formed by a width-direction center line L of the narrow groove mz and the toe-heel direction. As the width-direction center line L, FIG. 2 shows a width-direction center line L1 of the narrow groove mz1, a width-direction center line L2 of the narrow groove mz2, and a width-direction center line L3 of the narrow groove mz3. For determining the width-direction center line L, a face-back direction center point of an opening width of the narrow groove mz is considered. A set of the face-back direction center points is the width-direction center line L. The width-direction center line L is determined on the plan view (FIG. 2) of the head 2. The angle formed by the width-direction center line L and the toe-heel direction is an angle on the plan view (FIG. 2) of the head 2. The plan view is also referred to as a planar view.

The narrow groove mz1 located on the most face side is the longest in the narrow grooves mz. The narrow groove mz3 located on the most back side is the shortest in the narrow grooves mz. The narrow groove mz2 is shorter than the narrow groove mz1. The narrow groove mz3 is shorter than the narrow groove mz2. The narrow grooves mz are shortened toward the back side. The length of the narrow groove mz is measured along the toe-heel direction.

The narrow groove mz1 is located on the back side relative to the hosel hole 12. All the narrow grooves mz are located on the back side relative to the hosel hole 12. The narrow groove mz1 is located on the back side relative to a hosel end face 12*a*. All the narrow grooves mz are located on the back side relative to the hosel end face 12*a*.

The narrow groove mz1 is located on the back side relative to the third region R3. All the narrow grooves mz are located on the back side relative to the third region R3.

A position Pc shown in FIG. 2 is a position that divides the head width D into two equal parts. The position Pc is a position in the face-back direction.

The narrow groove mz3 is located on the face side relative to the position Pc. All the narrow grooves mz are located on the face side relative to the position Pc.

The peak portion pk is located on the face side relative to the position Pc.

The peak portion pk is located on the toe side relative to the face center Fc. However, a toe-heel direction distance between the peak portion pk and the face center Fc is small. The toe-heel direction distance between the peak portion pk and the face center Fc is preferably less than or equal to 20 mm, and more preferably less than or equal to 15 mm.

As to the above-described position Pb, the narrow groove mz1 is located on the face side relative to the position Pb. The narrow groove mz3 is located on the back side relative to the position Pb. The location of the first region R1 includes the position Pb.

The peak portion pk is located on the back side relative to the narrow groove mz1. The peak portion pk is located between the narrow groove mz1 and the narrow groove mz2. The peak portion pk may be located on the face side relative to the narrow groove mz1. The peak portion pk may be located between the narrow groove mz2 and the narrow groove mz3. The peak portion pk may be located on the back side relative to the narrow groove mz3.

The peak portion pk may be located on one of the narrow grooves mz. For example, the peak portion pk may be located on the narrow groove mz1. The peak portion pk may be located on the narrow groove mz2. The peak portion pk may be located on the narrow groove mz3.

As well shown in FIG. 3 and FIG. 4, the first region R1 includes a first thick portion M1. The first thick portion M1 has a wall thickness of T1 (mm). The first thick portion M1 is a region having a wall thickness of T1. T1 is the largest wall thickness in the crown 6. The first thick portion M1 is a largest wall-thickness portion that has the largest wall thickness in the crown 6. The first thick portion M1 is provided in the first region R1 only.

The first region R1 includes the first thick portion M1 and the narrow grooves mz. More specifically, the first region R1 includes the whole first thick portion M1 and parts of the narrow grooves mz. The first region R1 is constituted by only the first thick portion M1 and the narrow grooves mz. The first region R1 does not include the second thick portion M2.

Each narrow groove mz is formed by the first thick portion M1 located on both sides of the narrow groove mz. The narrow groove mz is formed by the first thick portion M1 adjacent to the face side of the narrow groove mz, and the first thick portion M1 adjacent to the back side of the narrow groove mz. As shown in an enlarged portion of FIG. 4, a face side surface ms1 of the narrow groove mz is formed by a first thick portion M11 adjacent to the face side of the narrow groove mz. Aback side surface ms2 of the narrow groove mz is formed by a first thick portion M12 adjacent to the back side of the narrow groove mz. The first thick portion M1 is divided by the narrow grooves mz.

The second region R2 includes the second thick portion M2. The second region R2 further includes the narrow grooves mz. The second region R2 includes the whole second thick portion M2 and parts of the narrow grooves mz. The second region R2 is constituted by only the second thick portion M2 and the narrow grooves mz. The second thick portion M2 is provided in the second region R2 only. The second region R2 does not include the first thick portion M1.

The second thick portion M2 occupies almost the whole second region R2. Of the second region R2, a portion excluding the narrow grooves mz is the second thick portion M2. The ratio of the area of the second thick portion M2 to the area of the second region R2 is preferably greater than or equal to 90%, and more preferably greater than or equal to 95%. This ratio may be 100%.

The second thick portion M2 has a wall thickness of T2 (mm) (see FIG. 4). The second thick portion M2 is a region having a wall thickness of T2. T2 is smaller than T1.

The crown 6 has a wall thickness in the narrow grooves mz of TG (mm) (see FIG. 4). TG is smaller than T2. TG is smaller than T1. The narrow grooves mz are smallest wall-thickness portions having the smallest wall thickness in the crown 6.

The third region R3 has a wall thickness of T3 (mm) (see FIG. 4). T3 is smaller than or equal to T1. T3 may be equal to T1. T3 may be smaller than T1. T3 is greater than T2. T3 may be smaller than T2. T3 may be equal to T2.

In the present application, wall thicknesses of the crown, such as T1, T2, T3, T4, Tt and TG, are measured along the direction of a line normal to the outer surface 18 of the crown 6. The direction of the normal line is determined at each measurement point.

As shown in FIG. 2, each narrow groove mz has a toe-side end Et and a heel-side end Eh. The narrow groove mz1 includes a toe-side end Et1 and a heel-side end Eh1. The narrow groove mz2 includes a toe-side end Et2 and a heel-side end Eh2. The narrow groove mz3 includes a toe-side end Et3 and a heel-side end Eh3. FIG. 5 shows the toe-side end Et2 of the narrow groove mz2 and the heel-side end Eh2 of the narrow groove mz2.

The crown 6 includes a transition region Rt. As shown in FIG. 2, the transition region Rt is located between the first region R1 and the second region R2. As shown in FIG. 2, the transition region Rt has a half-annular shape. An inner boundary line k1 of the transition region Rt is the boundary line between the first region R1 and the transition region Rt. An outer boundary line k2 of the transition region Rt is the boundary line between the transition region Rt and the second region R2.

The transition region Rt may not be present. The second region R2 may be adjacent to the first region R1.

The transition region Rt includes a thickness transition portion Mt. As shown in FIG. 6, the thickness transition portion Mt has a wall thickness Tt of changing from T1 to T2. Tt gradually changes from T1 to T2. Tt is increased toward the first region R1. Tt is decreased toward the second region R2.

The transition region Rt includes the thickness transition portion Mt and the narrow grooves mz. More specifically, the transition region Rt includes the whole thickness transition portion Mt and parts of the narrow grooves mz. The transition region Rt is constituted by only the thickness transition portion Mt and the narrow grooves mz.

FIG. 7 is a plan view in which a part of FIG. 2 is enlarged. In FIG. 7, the regions are shown using respective hatchings. The first region R1 is shown by a solid-line hatching. The second region R2 is shown by a dashed-line hatching. The third region R3 is shown by a two-dot-chain-line hatching.

The crown 6 includes a fourth region R4. In FIG. 7, the fourth region R4 is a plain portion without hatching. The fourth region R4 is adjacent to the back side of the third region R3. The fourth region R4 extends from the toe side to the heel side.

The fourth region R4 can be a second thickness transition portion. The fourth region R4 includes a portion located on a boundary between the third region R3 and the second region R2. In this portion, the fourth region R4 may have a wall thickness T4 of gradually changing from T3 to T2. The fourth region R4 includes a portion located on a boundary between the third region R3 and the first region R1. In this portion, the fourth region R4 may have a wall thickness T4 of gradually changing from T3 to T1. T4 is preferably smaller than T1.

As described above, the first region R1 is shown by the solid-line hatching. As described above, the first region R1 is a semicircular region. Of the first region R1, portions excluding the narrow grooves mz are the first thick portion M1. The narrow grooves mz are long and narrow regions surrounded by dashed lines.

As described above, the second region R2 is shown by the dashed-line hatching. The second region R2 is disposed so as to surround the transition region Rt on the toe side, the back side and the heel side. The transition region Rt is disposed so as to be adjacent to the outside of the first region R1, and the second region R2 is disposed so as to be adjacent to the outside of the transition region Rt. Of the second region R2, a portion excluding the narrow grooves mz is the second thick portion M2. Toe-side end portions and heel-side end portions of the narrow grooves mz are located in the second region R2, and are not the second thick portion M2.

The transition region Rt is shown by a one-dot-chain-line hatching. The transition region Rt is a half-annular region. Of the transition region Rt, portions excluding the narrow grooves mz are the thickness transition portion Mt.

As shown in FIG. 7, the narrow groove mz1 intersects the first region R1. The toe-side end portion of the narrow groove mz1 reaches the second region R2 by the narrow groove mz1 being continuous from the first region R1 and intersecting the transition region Rt. The heel-side end portion of the narrow groove mz1 reaches the second region R2 by the narrow groove mz1 being continuing from the first region R1 and intersecting the transition region Rt.

The narrow groove mz2 intersects the first region R1. The toe-side end portion of the narrow groove mz2 reaches the second region R2 by the narrow groove mz2 being continuous from the first region R1 and intersecting the transition region Rt. The heel-side end portion of the narrow groove mz2 reaches the second region R2 by the narrow groove mz2 being continuous from the first region R1 and intersecting the transition region Rt.

The narrow groove mz3 intersects the first region R1. The toe-side end portion of the narrow groove mz3 reaches the second region R2 by the narrow groove mz3 being continuous from the first region R1 and intersecting the transition region Rt. The heel-side end portion of the narrow groove mz3 reaches the second region R2 by the narrow groove mz3 being continuous from the first region R1 and intersecting the transition region Rt.

Thus, all the narrow grooves mz intersect the first region R1. The toe-side end portions of all the narrow grooves mz reach the second region R2 by the narrow grooves mz being continuous from the first region R1 and intersecting the transition region Rt. The heel-side end portions of all the narrow grooves mz reach the second region R2 by the narrow grooves mz being continuous from the first region R1 and intersecting the transition region Rt.

As shown in FIG. 7, the narrow groove mz1 divides the first region R1. That is, the narrow groove mz1 extends from a toe-side edge t10 of the first region R1 to a heel-side edge h10 of the first region R1. The toe-side edge t10 is located on the toe side relative to the peak portion pk. The heel-side edge h10 is located on the heel side relative to the peak portion pk.

The narrow groove mz2 divides the first region R1. That is, the narrow groove mz2 extends from a toe-side edge t20 of the first region R1 to a heel-side edge h20 of the first region R1. The toe-side edge t20 is located on the toe side relative to the peak portion pk. The heel-side edge h20 is located on the heel side relative to the peak portion pk.

The narrow groove mz3 divides the first region R1. That is, the narrow groove mz3 extends from a toe-side edge t30 of the first region R1 to a heel-side edge h30 of the first region R1. The toe-side edge t30 is located on the toe side relative to the peak portion pk. The heel-side edge h30 is located on the heel side relative to the peak portion pk.

Thus, all the narrow grooves mz divide the first region R1.

As shown in FIG. 7, the narrow groove mz1 divides the transition region Rt. The narrow groove mz1 divides the transition region Rt at two locations. The narrow groove mz1 divides the transition region Rt on the toe side and the heel side. On the toe side, the narrow groove mz1 extends from an inner edge t10 of the transition region Rt to an outer edge t12 of the transition region Rt. On the heel side, the narrow groove mz1 extends from an inner edge h10 of the transition region Rt to an outer edge h12 of the transition region Rt. The inner edge t10 and the outer edge t12 are located on the toe side relative to the peak portion pk. The inner edge h10 and the outer edge h12 are located on the heel side relative to the peak portion pk.

The narrow groove mz2 divides the transition region Rt. The narrow groove mz2 divides the transition region Rt at two locations. The narrow groove mz2 divides the transition region Rt on the toe side and the heel side. On the toe side, the narrow groove mz2 extends from an inner edge t20 of the transition region Rt to an outer edge t22 of the transition region Rt. On the heel side, the narrow groove mz2 extends from an inner edge h20 of the transition region Rt to an outer edge h22 of the transition region Rt. The inner edge t20 and the outer edge t22 are located on the toe side relative to the peak portion pk. The inner edge h20 and the outer edge h22 are located on the heel side relative to the peak portion pk.

The narrow groove mz3 divides the transition region Rt. The narrow groove mz3 divides the transition region Rt at two locations. The narrow groove mz3 divides the transition region Rt on the toe side and the heel side. On the toe side, the narrow groove mz3 extends from an inner edge t30 of the transition region Rt to an outer edge t32 of the transition region Rt. On the heel side, the narrow groove mz3 extends from an inner edge h30 of the transition region Rt to an outer edge h32 of the transition region Rt. The inner edge t30 and the outer edge t32 are located on the toe side relative to the peak portion pk. The inner edge h30 and the outer edge h32 are located on the heel side relative to the peak portion pk.

Thus, all the narrow grooves mz divide the transition region Rt. All the narrow grooves mz divide the transition region Rt at two locations. All the narrow grooves mz divide the transition region Rt on the toe side and the heel side.

Figure 8:
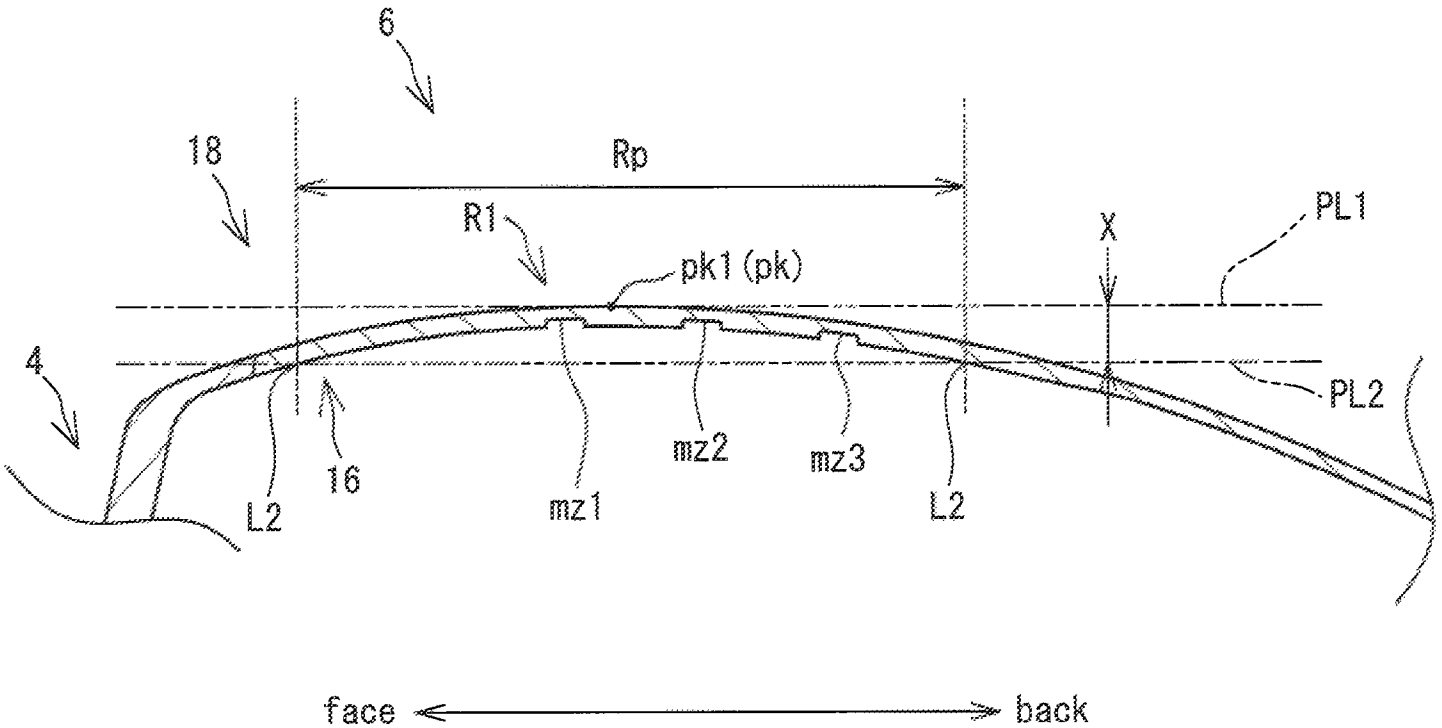
FIG. 8 is the same enlarged cross-sectional view as FIG. 4.

FIG. 8 is the same enlarged cross-sectional view as FIG. 4.

In the present application, a peak vicinity region is defined. The peak vicinity region is a region that is located on an up-down direction position falling within X mm of the peak portion pk. The peak vicinity region is determined based on the outer surface 18 of the crown 6. As shown in FIG. 8, of the peak portion pk, an outer peak point pk1 located on the outer surface 18 of the crown 6 is determined. When the peak portion pk is a region, not a point, the outer peak point pk1 is a center of figure of the region in the planar view.

A first virtual plane PL1 that includes the outer peak point pk1 is defined. The first virtual plane PL1 is parallel to the horizontal plane HP. Moreover, a second virtual plane PL2 that is located at a position separated downward by X mm from the outer peak point pk1 is defined. The second virtual plane PL2 is also parallel to the horizontal plane HP. Intersection lines L2 of the second virtual plane PL2 and the inner surface 16 of the crown 6 are determined. A portion surrounded by the intersection lines L2 is the peak vicinity region Rp (see FIG. 8).

The first thick portion M1 is included in the peak vicinity region Rp located on the up-down direction position falling within X mm of the peak portion pk. The peak vicinity region Rp includes the whole first thick portion M1. The peak vicinity region Rp includes the whole first region R1.

If X (mm) for defining the peak vicinity region Rp is excessively large, the peak vicinity region Rp is too enlarged. In this respect, X (mm) is preferably 12 (mm). In light of further narrowing the peak vicinity region Rp thereby to concentrate a region in which the first thick portion M1 is present in the vicinity of the outer peak point pk1, X (mm) may be 10 (mm), or may be 8.5 (mm).

As described above, in the head 2, the narrow grooves mz are formed on the inner surface 16 of the crown 6. In the head 2, the narrow grooves mz are not formed on the outer surface 18 of the crown 6.

Figure 9:
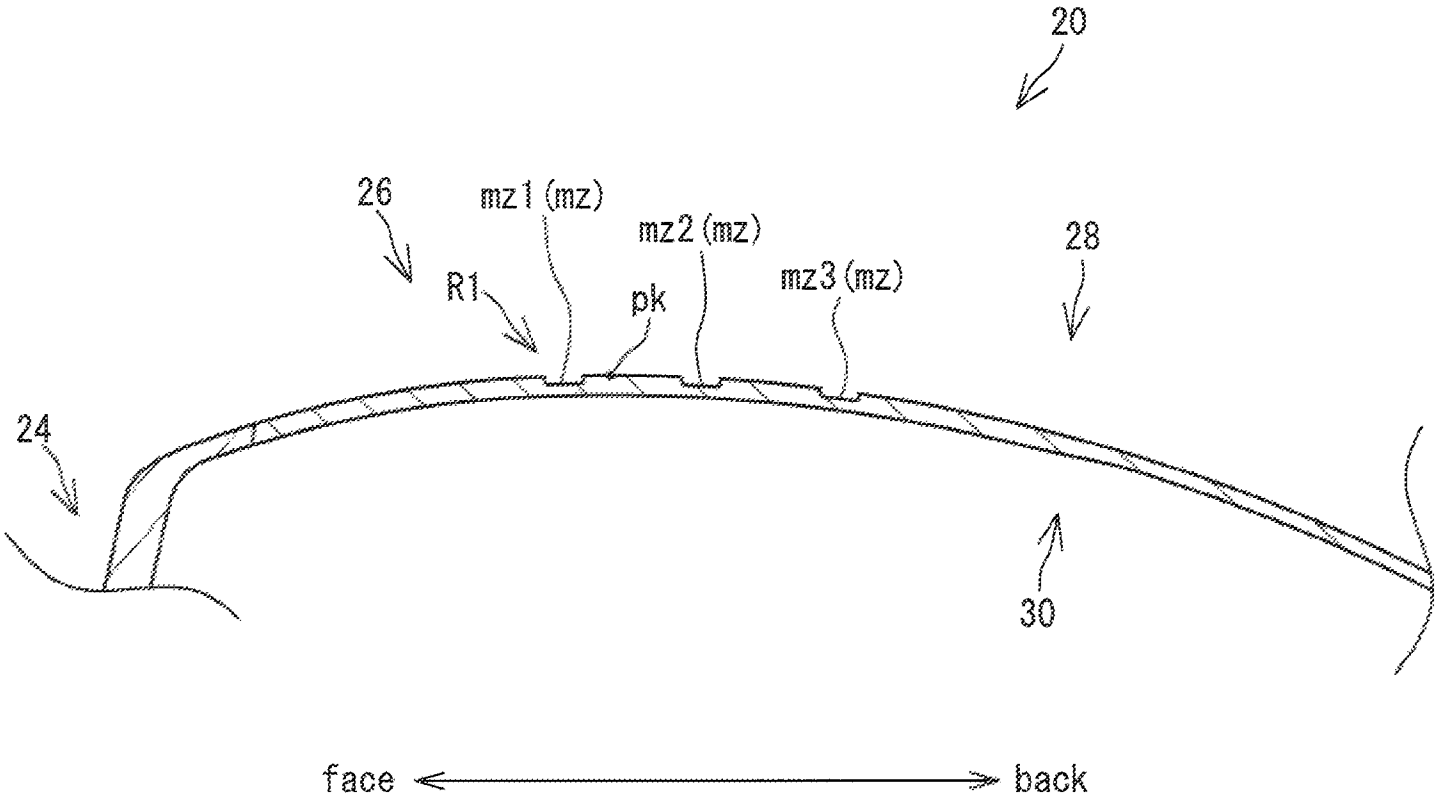
FIG. 9 is an enlarged cross-sectional view of a head according to a modification example.

The narrow grooves mz may be formed on the outer surface of the crown. FIG. 9 shows a cross-sectional view of a head 20 according to a modification example. In FIG. 9, the head 20 includes a face 24 and a crown 26. In the head 20, the narrow grooves mz are formed on an outer surface 28 of the crown 26. In the head 20, the narrow grooves mz are not formed on an inner surface 30 of the crown 26.

The narrow grooves mz may be formed on both the outer surface and the inner surface of the crown.

As described above, the first region R1 is located on a position that includes the peak portion pk. The first region R1 includes the first thick portion M1 having a large wall thickness. The first region R1 is constituted by only the first thick portion M1 and the narrow grooves mz. A certain amount of weight is distributed to the upper portion of the crown by the presence of the first region R1, whereby an up-down MI is increased. The up-down MI means a moment of inertia of the head. When an axial line passing through the center of gravity of the head and extending in the toe-heel direction is denoted by ZL1, the up-down MI is the moment of inertia about the axial line ZL1. Thus, the first region R1 achieves an effect of increasing the up-down MI.

The increase in the up-down MI suppresses deviations of the head resulting from variations of hitting points in the up-down direction. As a result, variations in flight distance can be decreased.

The inventor conducted an analysis of hitting points of high-level golf players such as professional golf players, and has found that high-level golf players often hit balls at an upper side relative to a sweet spot. By hitting a ball at an upper side relative to the sweet spot, the hitting surface is leaned toward a direction in which the loft angle is increased, and thus a dynamic loft is increased. As a result, a launch angle of the hit ball is increased. High-level golf players tend to prefer this increased launch angle.

However, as a result of hitting at an upper side relative to the sweet spot, the hitting point is likely to be located apart from the sweet spot. When the hitting point is located apart from the sweet spot, rebound performance deteriorates. The deterioration in rebound performance decreases flight distance.

In addition, when the hitting point is located apart from the sweet spot, a backspin rate is decreased due to a gear effect.

When the backspin rate is excessively low, a lifting force that acts on the hit ball is decreased. High-level golf players can intentionally add sidespin to hit a fade or a draw. When the backspin rate is excessively low, the lifting force becomes insufficient, whereby the flight distance deteriorates when the sidespin is added. As a result, controllability of the hit ball is worsened.

In the present embodiment, a certain amount of weight is distributed to the upper side by the presence of the first thick portion M1. For this reason, the sweet spot is shifted to the upper side to be closer to the hitting points. As a result, the rebound performance is enhanced. In addition, the gear effect is suppressed by making the sweet spot closer to the hitting points. For this reason, the backspin rate is increased, thereby suppressing reduction in flight distance when the sidespin is added. As a result, controllability of the hit ball is enhanced.

In addition, the whole first thick portion M1 is located in the peak vicinity region Rp. For this reason, the sweet spot is shifted to the upper side to further enhance the rebound performance and the controllability of the hit ball.

The first thick portion M1 increases the rigidity of the crown. The increased rigidity suppresses elastic deformation of the crown at hitting, and thus can reduce the rebound performance of the head. In the present embodiment, the narrow grooves mz extending from the toe side to the heel side are formed, whereby the rigidity of the crown against the hitting force can be reduced. As a result, reduction in rebound performance of the head is suppressed.

As described above, the narrow grooves mz extend so as to divide the first region R1. For this reason, the effect of reducing the rigidity of the crown is further enhanced.

As described above, the narrow grooves mz extend so as to divide the transition region Rt. For this reason, the effect of reducing the rigidity of the crown is further enhanced.

In the head 2, the narrow grooves mz are formed on the inner surface 16 of the crown 6. The crown 6 is bent so as to contract in the face-back direction by hitting. The narrow grooves mz formed on the inner surface 16 facilitates the bending of the crown 6. Therefore, the rebound performance is enhanced. Note that like the head 20 shown in FIG. 9, the narrow grooves mz may be disposed on the outer surface of the crown. Also in this case, the rigidity of the crown is suppressed as compared with a crown having no narrow grooves mz.

As described above, the wall thickness T1 of the first thick portion M1 is greater than the wall thickness T2 of the second thick portion M2. In light of increasing the weight of the first region R1, a ratio (T1/T2) is preferably greater than or equal to 1.1, more preferably greater than or equal to 1.2, and still more preferably greater than or equal to 1.3. In view of the strength of the crown 6, an excessively small wall thickness T2 is not preferable. In this respect, the ratio (T1/T2) is preferably less than or equal to 2, more preferably less than or equal to 1.9, and still more preferably less than or equal to 1.8. In the head 2, the wall thickness T1 was set to 1.0 mm, and the wall thickness T2 was set to 0.75 mm.

The wall thickness TG of the crown in the narrow grooves mz is smaller than the wall thickness T1, and also smaller than the wall thickness T2. The increased rigidity of the crown due to the presence of the first thick portion M1 can be effectively reduced by decreasing the wall thickness TG. The narrow grooves mz can effectively reduce the rigidity of the first region R1 while maintaining the weight distribution to the first region R1. In the head 2, the wall thickness TG was set to 0.6 mm.

The wall thickness TG in the narrow grooves mz is, for example, preferably greater than or equal to 0.3 mm and preferably less than or equal to 0.7 mm. Particularly in light of the effect of rigidity reduction, the wall thickness TG is, for example, preferably less than or equal to 0.6 mm. The wall thickness T1 is preferably greater than or equal to 0.6 mm and preferably less than or equal to 1.2 mm. The wall thickness T2 is preferably greater than or equal to 0.4 mm and preferably less than or equal to 0.9 mm.

In the head 2 and the head 20, the number of the narrow grooves mz is 3. The number of the narrow grooves mz is not limited. In light of increasing weight distribution to the first region R1, the number of the narrow grooves mz is preferably less than or equal to 8, more preferably less than or equal to 7, and still more preferably less than or equal to 6. In light of suppressing the rigidity of the first region R1 and facilitating the bending of the crown, the number of the narrow grooves mz is preferably greater than or equal to 1, more preferably greater than or equal to 2, and still more preferably greater than or equal to 3.

As shown in FIG. 2, the narrow grooves mz extend along the upper edge 4*a* of the face 4. All the narrow grooves mz extend along the upper edge 4*a* of the face 4. The narrow grooves mz arc substantially perpendicular to a direction in which a force caused by the impact of a ball is applied. The narrow grooves mz extending in such a direction facilitate the deformation of the crown 6 by the force. The narrow grooves mz can effectively reduce the rigidity of the first region R1 against the force while maintaining the weight distribution to the first region R1.

The aboved-described "the narrow grooves mz extend along the upper edge 4*a* of the face 4" means that the rate of change in the face-back direction distance between the width-direction center line L and the upper edge 4*a* is less than or equal to 5%. The face-back direction distance is measured in the planar view (FIG. 2).

In light of increasing weight distribution to the first region R1, the proportion of the first thick portion M1 in the first region R1 is preferably large. When the area of the first region R1 is denoted by AR1, and the area of the first thick portion M1 is denoted by AM1, then a ratio (AM1/AR1) is preferably greater than or equal to 0.6, more preferably greater than or equal to 0.65, and still more preferably greater than or equal to 0.7. In view of the presence of the narrow grooves mz, the ratio (AM1/AR1) is preferably less than or equal to 0.98, more preferably less than or equal to 0.95, and still more preferably less than or equal to 0.9. The area AR1 and the area AM1 are measured in the planar view.

In light of concentrating weight to the first region R1, the area of the second thick portion M2 is preferably greater than the area AM1. When the area of the second thick portion M2 is denoted by AM2, a ratio (AM2/AM1) is preferably greater than or equal to 3, more preferably greater than or equal to 3.5, and still more preferably greater than or equal to 4. In view of the presence of the first thick portion M1, the ratio (AM2/AM1) is preferably less than or equal to 5, more preferably less than or equal to 4.8, and still more preferably less than or equal to 4.5. The area AM2 is measured in the planar view.

A head having a large head volume includes a hitting surface having a large area. In the head including the hitting surface having a large area, variations in hitting points in the up-down direction also tend to be increased. The variations can reduce the controllability of the hit ball. For this reason, the present disclosure is more effective in a head having a large head volume. In this respect, the head volume is preferably greater than or equal to 400 cc, more preferably greater than or equal to 420 cc, and still more preferably greater than or equal to 430 cc. In view of the Golf Rules, the head volume is preferably less than or equal to 470 cc.

The method for forming the narrow grooves mz is not limited. Examples of the formation method of the narrow grooves mz include casting, forging, NC processing, and chemical milling. In light of accuracy, the NC processing may be adopted.

The material of the head is not limited. Examples of the material of the head include metal and CFRP (carbon fiber reinforced plastic). Examples of the metal include one or more metals selected from pure titanium, a titanium alloy, stainless steel, maraging steel, an aluminum alloy, a magnesium alloy, and a tungsten-nickel alloy. Examples of stainless steel include SUS630 and SUS304. A specific example of stainless steel is CUSTOM 450 (manufactured by Carpenter Technology Corporation). Examples of the titanium alloy include 6-4 titanium (Ti-6Al-4V) and Ti-15V-3Cr-3Sn-3Al. As described above, the present disclosure is effective in a head having a large head volume. In this respect, the material of the head is preferably the titanium alloy. In the same respect, the material of the crown is preferably the titanium alloy.

The method for producing the head is not limited. Normally, a hollow head is produced by joining two or more members to each other. The method for producing each member that constitutes the head is not limited, and examples of the method include casting, forging, and press forming.

Examples of the structure of the head include a two-piece structure in which two members each of which is integrally formed are joined together, a three-piece structure in which three members each of which is integrally formed are joined together, and a four-piece structure in which four members each of which is integrally formed are joined together.

The present disclosure can be applied to all types of golf club heads such as a wood type head, a utility type head, and a hybrid type head.

The above description is merely illustrative example, and various modifications can be made without departing from the principles of the present disclosure.

What is claimed is:

1. A golf club head comprising:
a face;
a sole; and
a crown, wherein
the crown includes a first region and a second region,
the first region includes a peak portion of the crown,
the first region includes a first thick portion and at least one narrow groove,
the second region includes a second thick portion,
the narrow groove extends from a toe side to a heel side so as to divide the first region,
the second region extends from the toe side of the first region, through a back side of the first region, to the heel side of the first region,
the second thick portion has a wall thickness smaller than a wall thickness of the first thick portion,
the crown includes a peak vicinity region that is located on an up-down direction position falling within 12 mm of the peak portion, and an entirety of the first thick portion is included in the peak vicinity region,
the second thick portion extends all the way to a back-side end of the crown, and the first thick portion does not reach a boundary between the crown and the face.

2. The golf dub head according to claim 1, wherein the narrow groove is formed on an inner surface of the crown.

3. The golf club head according to claim 1, wherein the narrow groove is formed on an outer surface of the crown.

4. The golf club head according to claim 1, wherein
when a wall thickness of the crown in the first thick portion is denoted by T1 (mm), a wall thickness of the crown in the second thick portion is denoted by T2 (mm), and a wall thickness of the crown in the narrow groove is denoted by TG (mm),
T1 is greater than T2, and T2 is greater than TG.

5. The golf club head according to claim 1, wherein
the number of the at least one narrow groove is greater than or equal to 1 and less than or equal to 8.

6. The golf club head according to claim 1, wherein
the narrow groove extends along an upper edge of the face.

7. The golf club head according to claim 1, wherein
the crown further includes a transition region that is located between the first region and the second region, and
the narrow groove extends so as to divide the transition region.

8. The golf club head according to claim 1, wherein
the head has a volume of greater than or equal to 400 cc.

9. The golf club head according to claim 1, wherein
the second region has an area of 50% or more of an area of the crown.

10. The golf club head according to claim 1, wherein
the first region is constituted by only the first thick portion and the narrow groove.

11. The golf club head according to claim 1, wherein
the crown further includes a third region that is located on a face side relative to the first region and the second region, and
the third region extends along an upper edge of the face.

12. The golf club head according to claim 1, wherein
the at least one narrow groove comprises a plurality of narrow grooves, and all the narrow grooves divide the first region.

13. The golf club head according to claim 1, wherein
a wall thickness T1 of the crown in the first thick portion is a largest wall thickness in the crown.

14. The golf club head according to claim 1, wherein
a wall thickness TG of the crown in the narrow groove is a smallest wall thickness in the crown.

15. The golf club head according to claim 1, wherein
a wall thickness TG of the crown in the narrow groove is greater than or equal to 0.3 mm and less than or equal to 0.7 mm.

16. The golf club head according to claim 1, wherein
when an area of the first thick portion is denoted by AM1 and an area of the second thick portion is denoted by AM2, AM2/AM1 is greater than or equal to 3 and less than or equal to 5.

17. A golf club head comprising:
a face;
a sole; and
a crown, wherein
the crown includes a first region and a second region,
the first region includes a peak portion of the crown,
the first region includes a first thick portion and at least one narrow groove,
the second region includes a second thick portion,
the narrow groove extends from a toe side to a heel side so as to divide the first region,
the second region extends from the toe side of the first region, through a back side of the first region, to the heel side of the first region,
the second thick portion has a wall thickness smaller than a wall thickness of the first thick portion,
the second thick portion extends all the way to a back-side end of the crown, and the first thick portion does not reach a boundary between the crown and the face.

18. The golf club head according to claim 1, wherein the second thick portion extends all the way to a rear sole.

19. The golf club head according to claim 17, wherein, in the crown, a whole circumference of the first thick portion is surrounded by a region that has a wall thickness smaller than the wall thickness of the first thick portion.

20. The golf club head according to claim 17, wherein the first region has a contour line that is curved so as to project backward, and the second region is located outside the curved portion of the first region.

21. The golf club head according to claim 17, wherein the crown further includes a third region that is located on a face side relative to the first region and the second region, and the third region has a wall thickness smaller than the thickness of the first region.

22. The golf club head according to claim 17, wherein the crown further includes a third region that is located on a face side relative to the first region and the second region, and the third region has a wall thickness smaller than or equal to the wall thickness of the second region.

23. The golf club head according to claim 17, wherein the narrow groove has a toe-side end and a heel-side end, the narrow groove intersects the first region, and the toe-side end and the heel-side end are located in the second region.

24. The golf club head according to claim 17, wherein the second thick portion extends all the way from a toe side of the first thick portion to a toe-side end of the crown, and also extends all the way from a heel side of the first thick portion to a heel-side end of the crown.

25. The golf club head according to claim 17, wherein the wall thickness of the first thick portion, the wall thickness of the second thick portion, and a wall thickness of the crown in the narrow groove are measured from an outer surface to an inner surface of the crown.

26. The golf club head according to claim 25, wherein no recess is provided on the outer surface of the crown in the first thick portion, and the wall thickness of the first thick portion is measured along a line normal to the outer surface of the crown at each measurement point.

* * * * *